US005306336A

United States Patent [19]

Martyak et al.

[11] Patent Number: 5,306,336

[45] Date of Patent: Apr. 26, 1994

[54] SULFATE-FREE ELECTROLESS COPPER PLATING BATHS

[75] Inventors: Nicholas M. Martyak, Ballwin; Bruce F. Monzyk, Maryland Heights; Henry H. Chien, St. Louis, all of Mo.

[73] Assignee: Monsanto Company, St. Louis, Mo.

[21] Appl. No.: 979,097

[22] Filed: Nov. 20, 1992

[51] Int. Cl.[5] ..... C23C 18/38

[52] U.S. Cl. ..... 106/1.23; 106/1.26

[58] Field of Search ..... 106/1.23, 1.26

[56] References Cited

U.S. PATENT DOCUMENTS

| | | | |
|---|---|---|---|
| 3,793,038 | 2/1974 | Maguire | 106/1.26 |
| 4,099,974 | 7/1978 | Morishita et al. | 106/1.26 |
| 4,167,601 | 9/1979 | Beckenbaugh et al. | 106/1.18 |
| 4,248,633 | 2/1981 | Heijnen et al. | 106/1.26 |
| 4,279,948 | 7/1981 | Kukanskis et al. | 106/1.23 |
| 4,301,196 | 11/1981 | McCormack et al. | 106/1.23 |
| 4,303,443 | 12/1981 | Miyazawa et al. | 106/1.26 |
| 4,450,191 | 5/1984 | Arcilesi | 106/1.26 |
| 4,539,044 | 9/1985 | Abu-Moustafa et al. | 106/1.26 |
| 4,814,009 | 3/1989 | Kondo et al. | 106/1.26 |
| 4,834,796 | 5/1989 | Kondo et al. | 106/1.26 |

FOREIGN PATENT DOCUMENTS 217580 9/1986 Japan .

*Primary Examiner*—Helene Klemanski

*Attorney, Agent, or Firm*—Thomas E. Kelley; Mark F. Wachter

[57] ABSTRACT

Sulfate-free electroless copper baths comprising cupric ions, formaldehyde, formate ions, hydroxyl ions, a copper counterion, e g. preferably a monovalent anion such as acetate, nitrate or formate, and copper chelant such as an alkali metal salt of aminotris(methylenephosphonic acid), biscarboxymethylaspartic acid, ethylenediaminetetra(methylenephosphonic acid), diethylenetriaminepenta(methylenephosphonic acid), gluconic acid, 1-hydroxyethylidene-1,1-diphosphonic acid, mucic acid, D-saccharac acid, tartaric acid and N,N,N',N'-tetrakis(2-hydroxypropyl)ethylenediamine are amenable to the recovery of copper, e.g. from purge streams, using the methods and apparatus including solvent extraction, e.g. employing hydroxamic acid extractants, anion filtration, ion-exchange and chelant precipitation.

8 Claims, No Drawings

SULFATE-FREE ELECTROLESS COPPER PLATING BATHS

Disclosed herein are sulfate-free plating baths for the electroless deposition of copper and methods of making and using such plating baths. Also disclosed are methods of recycling materials from such baths and treating baths for disposal.

BACKGROUND OF THE INVENTION

Plating baths for the electroless deposition of copper typically comprise a copper salt, commonly copper sulfate, a complexing agent such as EDTA and a reducing agent commonly formaldehyde. As copper is depleted from such plating baths, formaldehyde is oxidized to a formate and excess sulfate ions are generated. Copper ions and formaldehyde can be added to replenish a plating bath. Removal of formate and sulfate ions can be effected by withdrawing a purge stream. Besides the unwanted formate and sulfate ions, a purge stream also contains valuable species such as copper ions, formaldehyde and EDTA. Environmental awareness of the robustness of EDTA for the mobilization of toxic metals makes it less desirable to dispose of EDTA-containing solutions in waste streams.

Spent plating baths are traditionally treated by adding reducing agent such as sodium borohydride to precipitate elemental metal; residual soluble metal is precipitated with strong complexing agents, e.g. dithiocarbamate. Metal chelant complexes can be decomposed by oxidizing chelants, e.g. with peroxides, perchlorates or other oxidizing acids.

Because of the difficulties in treating spent plating baths, disposal in landfills is often a method of choice for disposing of spent plating solutions or metal sludge precipitate from plating baths. For instance, metal recyclers often prefer to avoid spent electroless nickel solutions because of the high phosphorus content.

U.S. Pat. No. 5,039,497 discloses methods of removing copper from sulfate solutions using aliphatic oximes. Cognis, Inc (Santa Rosa, California) has disclosed that such an extraction process can be used to treat copper and nickel electroless solutions to reduce the metal content producing a solution suitable for disposal, e.g. by sewering Such solvent extraction methods have not been enthusiastically adopted for treating plating baths comprising copper complexed with EDTA, in part because common commercial extractants are not especially effective in extracting copper from complexes with EDTA.

Cardotte in U.S. Pat. No. 4,985,661 discloses the use of hyperfiltration membranes to process copper electroless plating solutions, e.g. to concentrate for re-use salts of EDTA. Such membranes are more permeable to formaldehyde and formate ions than EDTA salts. It has been found that a sufficiently high level of copper salts permeate such membranes both as formate salts and EDTA salts. Such copper-containing permeate streams are unsuitable for waste disposal in many places. Moreover, such EDTA-concentrated streams are typically unsuited for recycle without further treatment, e.g. to remove other anions, most commonly sulfate which is present as the principal copper counterion.

SUMMARY OF THE INVENTION

This invention provides sulfate-free, electroless copper plating baths, typically comprising as anionic species a copper chelant, a copper reducing agent and copper counterion. Formaldehyde, typically employed as the copper reducing agent, is oxidized to formate ion as copper is deposited as reduced metal.

In one aspect of this invention electroless copper plating baths comprise monovalent counterions for copper. In such baths excess generated monovalent species, e.g. copper counterions and formate ions, are advantageously removed from other species of value, e.g. cupric ions and polyvalent chelant, by anion filtration. In a preferred embodiment, formate is employed as a monovalent counterion for copper.

In another aspect of this invention electroless copper plating baths employ polyvalent chelant as the counterion. Purge streams of such baths are advantageously treated by anion filtration which separates monovalent formate ion from polyvalent chelant which can be recycled with metal values without further treatment.

Another aspect of this invention provides methods and apparatus for removing and, preferably recycling, cupric ion from purge streams and otherwise spent baths using solvent extraction, ion exchange, crystallization and/or anion filtration operations.

These and other aspects and advantages of the subject matter of this invention will be apparent from the following detailed description and illustrative examples.

DETAILED DESCRIPTION OF PREFERRED EMBODIMENTS

As used herein the term "chelant" means a compound which can form a soluble copper complex in electroless copper plating baths. Compounds known as sequestrants are intended to be within the scope of the term chelant as it is used herein.

In one aspect of this invention the sulfate-free, electroless copper baths comprise monovalent anions as counterions for ionic copper. Copper is predominately present in the bath as copper(II), referred to herein as cupric ions. It is believed that electroless copper plating baths inevitably contain copper(I) species, referred to as cuprous ions at some low concentration, typically less than 1 percent, more commonly in the ppm range. Because electroless copper baths are typically maintained at an alkaline pH, e.g. 12–13, a chelant, commonly EDTA, is used to prevent copper hydroxide precipitation.

Monovalent counterions for copper are preferably selected from the group consisting of acetate, formate, methylsulfate, nitrate, sulfamate, trichloroacetate and trifluoroacetate. A common reducing agent for electroless copper baths is formaldehyde. As electroless copper baths are used copper and formaldehyde are consumed, e.g. cupric ions are reduced to copper(0) as copper is deposited and formaldehyde is oxidized to the monovalent formate ion. Cupric salt and formaldehyde are typically added to replenish electroless plating baths with the result that such baths are progressively contaminated with oxidized reducing agent, e.g. formate ion, and excess copper counterion.

In one aspect of this invention the sulfate-free, electroless copper baths comprise a polyvalent chelant as the counterion for ionic copper. Replenishment of copper in such baths can be effected by electrolytic dissolution of copper into a chelant solution. For instance, electroless copper plating baths free of non-chelant counterion can be produced by electrolytically dissolving a copper anode in a chelant, e.g. tartrate, solution in the presence of a depolarizer, e.g. ammonia.

Alternatively, a concentrated copper salt can be provided on one side of a cationic membrane, e.g, a Nafion membrane; a current passed through the cell will transport copper cations from the salt side of the membrane to a chelant solution on the other side of the membrane.

Thus, the copper plating baths of this invention also comprise a chelant, preferable a polyvalent chelant such as EDTA. More preferably the polyvalent chelant is selected from the group consisting of an alkali metal salt of aminotris(methylenephosphonic acid), biscarboxymethylaspartic acid, ethylenediaminetetra(methylenephosphonic acid), diethylenetriaminepenta(methylenephosphonic acid), gluconic acid, 1-hydroxyethylidene-1,1-diphosphonic acid, mucic acid, D-saccharac acid, tartaric acid and N,N,N',N'-tetrakis(2-hydroxypropyl-)ethylenediamine. In other cases the copper baths of this invention will preferably comprise as a polyvalent chelant an alkali metal salt selected from the group consisting of an alkali citrate, alkali fumarate, alkali tartrate monosuccinate, alkali tartrate disuccinate, alkali tartronate and alkali nitrilotriacetate (NTA).

A preferred electroless copper plating bath of this invention, when in use, consists essentially of an aqueous solution of formaldehyde, monovalent formate ions, hydroxyl ions, cupric ions and a counterion for cupric ions selected from the group consisting of an alkali metal salt of aminotris (methylenephosphonic acid), biscarboxymethylaspartic acid, ethylenediaminetetra(-methylene-phosphonic acid), diethylenetriaminepenta(-methylenephosphonic acid), gluconic acid, 1-hydroxyethylidene-1,1-diphosphonic acid, mucic acid, D-saccharac acid, tartaric acid and N,N,N',N'-tetrakis(2-hydroxypropyl)ethylenediamine. Aminotris(methylenephosphonic acid) is available from Monsanto Company as Dequest 2000 sequestrant. Ethylenediaminetetra(methylene-phosphonic acid) is available from Monsanto Company as Dequest 2040 sequestrant. Diethylenetriaminepenta(methylenephosphonic acid) is available from Monsanto Company as Dequest 2060 sequestrant. 1-hydroxyethylidene-1,1-diphosphonic acid is available from Monsanto Company as Dequest 2010 sequestrant. N,N,N',N'-tetrakis(2-hydroxypropyl)ethylenediamine is available under the trademark QUADROL.

Another aspect of this invention provides copper plating baths with enhanced stability provided by the use of polyols with high vapor pressure, e.g DL-thrietol or pentaerythritol. The use of such polyols avoids the difficulty of maintaining a desired stabilizer concentration due to evaporation of commonly used alcohol stabilizers, e.g. methanol.

One of the major problems encountered with electroless copper solutions is their inherent instability, i.e. susceptibility to spontaneous decomposition. It is known in the art that particles in the plating solution can act as nucleation sites for the autocatalytic deposition process. Copper(I) is believed to be an intermediate species which may form cuprous oxide due to the high pH of the solution Precipitated cuprous oxide particles may then act as sites for copper deposition ultimately leading to spontaneous decomposition of the solution. Therefore one aspect of this invention provides cuprous ion chelants that facilitate solubilization of cuprous species. Typical commercial cuprous chelating agents include cyanide ions and 2,2-bipyridyl. Preferred cuprous chelants of the electroless copper plating solutions of this invention are 1,3-di(4-pyridyl)propane and DiSnadns 2,7-naphthalenedisulfonic acid-4,5-dihydroxy-3,6-bis((4-sulfo-1-naphthalenyl)azo)tetrasodium salt available from Lancaster Synthesis Ltd.

Depending on the economic value of the copper chelant and reducing agent, it is often desirable to separate the chelant and/or reducing agent from other species, e.g. oxidized reducing agent or excess counterion, present in the cupric chelant-depleted stream. Because the electroless plating baths of this invention comprise monovalent counterion for copper, both the monovalent counterion and monovalent formate ion can be advantageously separated from polyvalent chelants by anion filtration using porous membranes having anionically functionalized surface. Such membranes are more selectively permeable to neutral and monoanionic solutes and less permeable to polyvalent anionic solutes. Spent electroless copper plating baths of this invention are advantageously treated to recycle copper metal. Thus, one aspect of this invention provides methods for recycling copper metal where a copper electroless plating bath purge stream is directed into contact with an anion filtration membrane which is selectively permeable to monovalent anionic species. For instance, a purge stream comprising cupric ions, formate ions, formaldehyde, polyanionic copper chelant species and, unless otherwise provided by excess chelant or formate ions, a monovalent anionic counterion for copper, is conducted from an electroless copper plating bath to such a membrane filtration unit under sufficient pressure to effect permeation, resulting in a purge stream and a residual stream. The concentration of formate ions and formaldehyde in the purge stream and residual stream will be essentially the same as in purge stream. The concentration of cupric ions will be lower in the purge stream and higher in the residual stream than in the purge stream. When a monovalent anionic counterion is present, its concentration tends to remain essentially unchanged like that of other permeable species. The polyvalent chelant tends to concentrate with the cupric-chelant species. The residual stream can be recycled to the copper electroless deposition bath. The permeate stream can be conducted to an ion exchange unit containing a chelating ion exchange resin adapted to removing cupric ions from solutions in which cupric ions are not strongly complexed, e.g. as with EDTA. The effluent from such an ion exchange unit will be a stream essentially depleted of cupric ions but enriched in formate ions and formaldehyde. Multi-staged membrane filtration can provide substantial enhancement of separation efficiency.

In one aspect of this invention a first step to recycle copper metal comprises delivering a copper electroless plating bath purge stream comprising an aqueous solution of cupric ions, formate ions, formaldehyde and polyanionic cupric chelant species to a solvent extraction unit. Solvent extraction units typically comprise a series of mixing/settling vessels to provide intimate mixing and subsequent separation of an organic liquid and an aqueous liquid. Multi-staged extraction columns with countercurrent flow provide high efficiency liquid extraction. For example, an aqueous liquid comprising a purge stream from such an electroless copper plating bath is intimately mixed with an organic liquid containing a cupric-extractant, e.g. in kerosene. During intimate mixing of aqueous and organic liquids, metal ions cross the phase boundary into the organic solution as a complex with the extractant. When mixing is stopped the phases separate, e.g. in an automatic decanter apparatus. When a number of stages of such mixers and decanters are provided in a series, a high degree of efficiency can be attained, providing a cupric ion-depleted aqueous stream and a cupric-extractant organic stream. In summary solvent extraction units typically comprise means for contacting a metal-containing feed stream with an organic solvent solution and means for separating an organic stream containing metal-extractant complex and an aqueous stream depleted in said metal species.

Effective solvent extraction requires the use of an extractant which exhibits a binding energy in a cupric-extractant complex that is greater than the binding energy of cupric ions to the cupric chelant species in the copper electroless plating bath. The bond strength of EDTA-copper complexes is sufficiently high as to resist copper extraction by common extractants. Thus, preferred plating baths of this invention comprise a weaker binding chelant, e.g. D,L-tartaric acid, Na,K tartrate (Rochelle salts), mucic acid, gluconic acid, D-saccharac acid, N,N'-biscarboxymethylaspartic acid, N-phosphonomethyliminodiacetic acid, N,N'-bisphosphonomethylglycine, N-phosphonomethylglycine trisphosphonomethylamine, ethanol-1,1-bisphosphonic acid or a combination thereof.

Preferred metal extractants for use in this invention are hydroxamic acids which are advantageously capable of extracting copper from EDTA complexes. Preferred hydroxamic acids with enhanced hydrolytic stability for cost effective long term use include N-alkyl alkanohydroxamic acids, e.g. N-methyl alkylhydroxamic acids, N-ethyl alkyl hydroxamic acids. Especially preferred are N-ethyl hydroxamic acids disclosed in U.S. patent application Ser. No. 07/890,882.

In this method of recycling copper, an organic stream containing cupric-extractant complex is contacted with an acid stream to provide an aqueous stream having dissolved therein the cupric salt of said acid. When it is desired to recycle recovered copper directly into the plating bath, useful acids include any of the acids corresponding to the monovalent counterions preferred for use in this invention. When the copper is to be recovered for another use or further processing, other acids, including sulfuric acid, can be employed.

Because solvent extraction processes are seldom 100% effective in removing metal, the cupric ion-diminished aqueous stream from the solvent extraction step may contain sufficient copper, e.g. as cupric chelant complex, to preclude its direct disposal, e.g. in municipal sewage treatment facilities. Such residual copper-chelant complexes can often be removed by reducing the pH of the cupric ion-diminished aqueous stream, e.g. to pH less than 2, to selectively form a precipitate of polyanionic cupric chelant species which is readily removed by settling, filtration, centrifugation, etc. Removal of such precipitate provides a substantially cupric chelant-depleted stream. Trace amounts of copper, e.g. complexed with a weak chelant such as tartrate, can be removed by conducting the substantially cupric chelant-depleted stream to an ion exchange unit containing a chelating ion exchange resin capable of removing cupric ions from a solution in which cupric ions are complexed with weak chelant, thereby providing an effluent stream essentially depleted of cupric ions and substantially depleted of chelant species.

Regardless of recycling method, e.g. anion filtration or solvent extraction, it is generally preferred to reduce the pH of the purge stream to increase its stability against autocatalytic deposition of copper.

The preferred method for treating sulfate-free plating bath to allow recycling of valuable materials while producing an environmentally acceptable, i.e. biodegradable, waste stream depends on the chelant. For instance, with baths containing weak chelant, e.g. tartrate, the initial treatment of a purge stream can be either (i) anion filtration with recycle of the residual stream and the permeate stream being treated by chelant precipitation, if necessary, followed by ion exchange or (ii) liquid extraction where the raffinate stream is treated by chelant precipitation and ion exchange With baths containing strong chelants, e.g. EDTA, the initial treatment is preferably anion filtration which allows recycle of valuable EDTA as a copper complex; the chelant in the permeate stream can be destroyed, followed by ion exchange.

While the following examples illustrate the use of various materials in embodiments of plating solutions and methods of this invention, it should be clear from the variety of species illustrated that there is no intention of so limiting the scope of the invention. On the contrary, it is intended that the breadth of the invention illustrated by reference to the following examples will apply to other embodiments which would be obvious to practitioners in the plating arts.

EXAMPLE 1

This example illustrates the advantages of a variety of polyvalent chelants useful in the electroless copper plating baths of this invention, e.g. comprising 0.063M cupric ion, 0.20M Chelating Agent, 0.18M formaldehyde, 0.000115M cyanide ion. A variety of chelants as indicated in Table 1 were evaluated for stability and copper deposition rate on a standard substrate (rate indicates the percent increase in weight due to copper deposition per unit of time), and the brightness quality of electrolessly deposited copper in plating baths which were maintained at 26° C. and pH 12.4.

TABLE 1a

| Chelant | Rate | Stability | Copper |
|---|---|---|---|
| Gluconate | 22.2% | Some decomposition | Bright |
| DL Tartrate | 32.8% | Very stable | Bright |
| D-Saccharic Acid | 13.6% | Very stable | Bright |
| BCMA[1] | 17.3% | Stable; clear blue | Bright |
| Mucic Acid | 26.7% | Cloudy, deep blue | Bright |
| PMIDA[2] | 21.7% | Clear lt. blue sol. | Bright |
| BPMG[3] | 13.2% | Clear lt. blue sol. | Bright |
| Dequest 2000 | 28.6% | Clear, lt-blue sol. | Bright |
| Dequest 2010 | 32.7% | Clear, blue-green sol Ppt after 6 hrs. | Bright |

[1]biscarboxymethylaspartic acid
[2]phosphonomethyliminodiacetic acid
[3]N,N-bisphosphonomethylglycine TABLE 1b

| Chelant Copper | Rate | Stability | |
|---|---|---|---|
| Tartronic Acid | 29.5% | Green-turbid sol. With Precipitate | Semi-bright |
| Citrate | 120.1% | Decomposed w/in 2 hr. | Semi-bright |
| Fumaric Acid | 8.0% | Precipitate; gel | Semi-bright |
| Quadrol[1] | 28.4% | Deep blue sol. | bright |
| NTA[2] | 110.5% | Green solution | Semi-bright |

[1]4,4,4'4'-tetrakis(2-hydroxypropyl)ethylenediamine
[2]nitrilotriacetic acid

TABLE 1c

| Chelant Copper | Rate | Stability | |
|---|---|---|---|
| Malic Acid | 4.2% | Turned green after 5 min. | Brown |
| Glycolic Acid | 31.1% | Precipitates | Dull |
| Succinic Acid | — | Precipitates | n/a |
| Lactic Acid | — | Precipitates | n/a |
| Maleic Acid | 2.09% | Precipitates; gel | Dull |
| Oxalic Acid | 2.7% | Turbid blue | Gray |
| Oxydisuccinate | 3.6% | Turbid blue | Gray-brown |
| EDPA[1] | 1.2% | Precipitate | n/a |
| Malonic Acid | 4.5% | Precipitate | Brown |
| BTCA[2] | — | Precipitate | n/a |
| Diglycolic Acid | 4.5% | Precipitate | Brown |
| DL-Glyceric Acid | 5.6% | Precipitate | Brown |
| IDA[3] | 8.9% | Clear blue | Metallic brown |
| PMG[4] | 3.8% | Dark, blue solution | Gray-green |

[1]ethanediphosphonic acid
[2]butanetetracarboxylic acid
[3]iminodiacetic acid
[4]phosphonomethylglycine

EXAMPLE 2

This example illustrates the use of a chelant as the counterion in an electroless copper plating solution. A copper metal anode was dissolved into a basic tartrate (0.3M) solution using a split cell; platinum wire was the cathode. Ammonia was added to the anolyte solutions as a depolarizer. Because of its volatility ammonia is a preferred depolarizer over non-volatile salts which would increase the anionic content of the plating bath. 2.26 gm copper was dissolved by electrolysis. The ammonia depolarizer was removed by passing nitrogen gas through the solution providing a sulfate-free copper-tartrate solution which was stabilized by the addition of 3 ppm cyanide ion. After the addition of 0.18M formaldehyde, the solution was used to electrolessly deposit bright copper on catalyzed woven fabric, by methods disclosed by Vaughn in U.S. Pat. No. 5,082,734. The absence of a non-chelant counterion for copper, provides a plating bath adapted to extended operation with reduce purge demand.

EXAMPLE 3

This example illustrates the recovery of copper from an electroless copper plating solution comprising tartrate as a chelant. An electroless copper plating solution was prepared using 0.063M cupric ion, 0.2M tartrate, 0.18M formaldehyde, $1.15\times10^{-4}$M cyanide at pH 12.4. The solution was mixed with a 12% solution of N-ethyl decanohydroxamic acid in kerosene and allowed to settle, separating into two phases. Although phase separation was somewhat slow, separation was essentially complete with essentially no copper in the aqueous phase.

With a plating bath of similar composition but of pH of 8–10, phase separation was more rapid with essentially no residual copper in the aqueous phase.

When the procedure is repeated using EDTA, QUADROL, or NTA in place of tartrate, copper separation was significantly slower. Depending on the pH little or no copper extraction was effected. But with higher concentrations of hydroxamic acid, e.g. about 22%, enhanced copper extraction was demonstrated from solutions containing these stronger chelants.

While specific embodiments have been described herein, it should be apparent to those skilled in the art that various modifications thereof can be made without departing from the true spirit and scope of the invention. Accordingly, it is intended that the following claims cover all such modifications within the full inventive concept.

What is claimed is:

1. A sulfate-free electroless copper bath consisting of: cupric ions; cuprous ions; formaldehyde; formate ions; hydroxy ions; alkali metal ions; monovalent counterions for ionic copper selected from the group consisting of acetate, formate, sulfamate, methylsulfate, nitrate, trichloroacetate and trifluoroacetate; a cuprous ion chelant; and a cupric ion chelant selected from the group consisting of an alkali metal salt of one or more of aminotris(methylenephosphonic acid), biscarboxymethylaspartic acid, ethylenediaminetetra(methylenephosphonic acid), diethylenetri-aminepenta(methylenephosphonic acid), gluconic acid, 1-hydroxyethyl-idene-1,1-diphosphonic acid, mucic acid, D-saccharic acid, N,N,N',N'-tetrakis(2-hydroxypropyl)ethylenediamine and nitrilotriacetic acid.

2. A copper bath according to claim 1 wherein said cuprous chelant is selected from the group consisting of cyanide ions, 2,2-bipyridyl, 1,3-di(4-pyridyl)-propane and 2,7-naphthalenedi-sulfonic acid-4,5-dihydroxy-3,6-bis((4-sulfo-1-naphthalenyl)azo-tetrasodium salt.

3. A sulfate-free electroless copper bath consisting of monovalent counterions for ionic copper selected from the group consisting of acetate, formate, sulfamate, methylsulfate, nitrate, trichloroacetate and trifluoroacetate; a cuprous ion chelant; and a cupric ion chelant selected from the group consisting of an alkali tartronate, alkali citrate, alkali fumarate, alkali tartrate monosuccinate and alkali tartrate disuccinate.

4. A copper bath according to claim 3 wherein said cuprous chelant is selected from the group consisting of cyanide ions, 2,2-bipyridyl, 1,3-di(4-pyridyl)-propane and 2,7-naphthalenedi-sulfonic acid-4,5-dihydroxy-3,6-bis((4-sulfo-1-naphthalenyl)azo)-tetrasodium salt.

5. A sulfate-free electroless copper bath consisting of formaldehyde, formate ions, hydroxyl ions, cupric ions, cuprous ions a cuprous ion chelant, a cupric ion chelant as a counterion for cupric ions; wherein said cupric ion chelant is selected from the group consisting of an alkali metal salt of aminotris(methylenephosphonic acid), biscarboxy-methylaspartic acid, ethylenediaminetetra(-methylene-phosphonic acid), diethylenetriaminepenta(-methylenephosphonic acid), gluconic acid, 1-hydroxyethylidene-1,1-diphosphonic acid, mucic acid, D-saccharic acid, N,N,N',N'-tetrakis(2-hydroxypropyl) ethylenediamine and nitrilotriacetic acid.

6. A copper bath according to claim 5 wherein said cuprous ion chelant is selected from the group consisting of cyanide ions, 2,2-bipyridyl, 1,3-di(4-pyridyl)-propane and 2,7-naphthalenedi-sulfonic acid-4,5-dihydroxy-3.6-bis((4-sulfo-1-naphthalenyl)azo-tetrasodium salt.

7. A sulfate-free electroless copper bath consisting of formaldehyde, formate ions, cupric ions, cuprous ions, hydroxy ions, alkali metal ions, a cuprous ion chelant and D,L-tartrate as a cupric ion chelant.

8. A copper bath according to claim 7 wherein said cuprous chelant is selected from the group consisting of cyanide ions, 2,2-bipyridyl, 1,3-di(4-pyridyl)-propane and 2,7-naphthalenedi-sulfonic acid-4,5-dihydroxy-3,6-bis((4-sulfo-1-naphthalenyl)azo)-tetrasodium salt.

* * * * *